United States Patent [19]

Bugiel

[11] Patent Number: 4,665,791

[45] Date of Patent: May 19, 1987

[54] METHOD FOR ACCELERATING AN OBJECT AND PROPELLING ARRANGEMENT FOR IMPLEMENTING THE METHOD FOR SUCH OBJECT, PARTICULARLY AN OBJECT TO BE DRIVEN INTO GROUND BELOW WATER

[75] Inventor: Horst G. Bugiel, Bonn-Ippendorf, Fed. Rep. of Germany

[73] Assignee: Diehl GmbH & Co., Nuremberg, Fed. Rep. of Germany

[21] Appl. No.: 892,725

[22] Filed: Jul. 29, 1986

Related U.S. Application Data

[63] Continuation of Ser. No. 608,974, May 10, 1985, abandoned.

[30] Foreign Application Priority Data

May 18, 1983 [DE] Fed. Rep. of Germany ..... 3318017

[51] Int. Cl.[4] ..... E21B 49/02; F42B 15/00

[52] U.S. Cl. ..... 89/1.1; 89/1.809; 175/4; 175/20

[58] Field of Search ..... 89/1.1, 1.7, 1.809, 89/1.816; 102/371, 504, 411; 175/2, 4, 19, 20; 42/1 L

[56] References Cited

U.S. PATENT DOCUMENTS

| | | | |
|---|---|---|---|
| 271,524 | 5/1943 | Schlumberger | 175/4 |
| 1,661,091 | 2/1928 | Riabouchinski | 89/1.1 X |
| 2,993,461 | 7/1961 | Feiler | 102/504 X |
| 3,032,000 | 5/1962 | Feiler | 102/411 X |
| 3,036,542 | 5/1962 | Robinson | 102/441 X |
| 3,155,174 | 11/1964 | Niskin | 175/4 |
| 3,216,320 | 11/1965 | Thomas et al. | 89/1.1 X |
| 3,233,415 | 2/1966 | Thomas | 89/1.1 X |
| 3,313,357 | 4/1967 | Venghiattis | 175/4 X |
| 3,477,525 | 11/1969 | Farrell et al. | 175/4 |
| 4,505,179 | 3/1985 | Nelson et al. | 42/1 L X |

FOREIGN PATENT DOCUMENTS

| | | | |
|---|---|---|---|
| 268170 | 2/1969 | Austria | 175/4 |
| 1126237 | 7/1956 | France | 175/19 |
| 1605300 | 8/1974 | France | 89/1.7 |
| 1030298 | 5/1966 | United Kingdom . | |
| 1088294 | 10/1966 | United Kingdom . | |
| 279522 | 11/1970 | U.S.S.R. | 175/4 |

*Primary Examiner*—David H. Brown

*Attorney, Agent, or Firm*—Scully, Scott, Murphy & Presser

[57] ABSTRACT

A method for effectuating the acceleration of an object, in particular a piercing or penetrator object, within a surrounding liquid medium of a density which is higher than the density of gases, such as in water; as well as an arrangement for producing and imparting an advancing or propelling force to an object in a surrounding liquid medium of a density which is higher than the density of gases; and in particular to an obejct which is to be driven into a water bottom or seabed.

3 Claims, 2 Drawing Figures

METHOD FOR ACCELERATING AN OBJECT AND PROPELLING ARRANGEMENT FOR IMPLEMENTING THE METHOD FOR SUCH OBJECT, PARTICULARLY AN OBJECT TO BE DRIVEN INTO GROUND BELOW WATER

This application is a continuation of application Ser. No. 608,974, filed May 10, 1985 now abandoned.

BACKGROUND OF THE INVENTION

1. Field of the Invention

The present invention relates to a method for effectuating the acceleration of an object, in particular a piercing or penetrator object, within a surrounding liquid medium of a density which is higher than the density of gases, such as in water; as well as to an arrangement for producing and imparting an advancing or propelling force to an object in a surrounding liquid medium of a density which is higher than the density of gases; and in particular to an object which is to be driven into a water bottom.

2. Discussion of the Prior Art

It is known that, for the purpose of introducing a force into an object, an impulse is generated in the object, as a result of which the object is itself set into motion and is braked against a reaction member, or in which a propelling member is placed into motion and, as a result of being braked against the object, transmits an impulse to the latter.

In non-gaseous surrounding fluidic media which, in particular, are much denser relative to gases and are only slightly compressible, especially as in liquids, such as under high hydrostatic pressure in the liquid because of the respective working depth, it is difficult to operate work tools safely and to securely manipulate their movements, which are adapted to produce force impulses and to introduce these into an object, which will yield a work output or which should yield or produce a work output. A typical work output of that kind, for example, is the driving in of an anchoring or a ground sample retrieving tube into the water bottom or sea bed. It is attempted to produce significant forces under difficult operating conditions in order to drive the object sufficiently into the ground or bottom, and in which there is encountered the further difficulty that these operations are frequently required to be carried out at an extremely precise location on the ground or sea bottom inasmuch as this location is fixedly predetermined as a measurement or fastening reference point for calculating locations measured from these; in essence must be securely achieved. Basically, it can be considered to place the object into motion in a direction towards the penetrating location from a greater distance so that it will strike with a higher velocity and a correspondingly greater energy; however, due to the properties of the surrounding media there would be required an excessively lengthy approach path in order to achieve a sufficient velocity, as a consequence of which it becomes improbable that the object will strike precisely at the predetermined penetrating location, and in addition thereto, at the desired impact and entry direction.

SUMMARY OF THE INVENTION

Accordingly, in recognition of these difficulties and other conditions, it is an object of the present invention to provide a method as well as an arrangement of the above-mentioned type through which, even under a technologically unfavorable liquid environment or surrounding, extremely large forces can be brought to bear at a precisely defined location and in a precisely defined direction.

The foregoing object is inventively achieved in that the method is effectuated through the features of the inventive arrangement, wherein the arrangement is designed to incorporate a container for receiving a propellant charge at the rear side of the object, wherein the propellant charge is constituted of a combustible material with an explosion-like burn down behavior and with the development of a strong, rearwardly exiting combustion gas development.

Thus, it is a basic concept of the inventive subject matter that it should be possible to produce an extremely high, projectile-like acceleration of the piercing or penetrator object even in surrounding media in which a firing device of the type of a gun or weapon barrel would not be operational, or at least not practical; so that the object will attain the necessary velocity already over a short trajectory, as well as over a positional and directionally precisely defined traveling path, for the conversion of the kinetic energy into a high impact energy and as a result, is driveable into the ground or bottom in a precisely defined and assured manner.

Surprisingly, it has been evidenced that it is possible, without the reaction force of a surrounding device in the form of a weapon barrel, to burn down a propellant charge in the surrounding medium which has a higher density than the density of gases, without destroying the propellant charge container. Instead thereof, a dynamic damming up of the propellant charge is caused through the oncoming flow of the surrounding medium, as soon as the object, which has been placed into motion by the burning down propellant charge moves through the medium, with the result that the wall of the container will not only at the first moment of the ignition of the propellant charge but also from then on exert on the action or impulse forces orientation effect stabilizing the direction of movement of the object, which forces are released during the explosion-like burning down of the propellant charge. The combustion gases developed therefrom, due to the discharge guidance of the propellant charge container, build up rearwardly of the latter, a combustion gas bubble in the surrounding medium, which displace the incompressible medium, in effect, produce reaction forces in the surrounding medium along the interface of the gas bubble with the surrounding medium. These reaction forces and the further supply of the bubble with additional combustion gases will cause that the last-mentioned gases place the propellant charge container, and thereby also the object which is located ahead thereof, into movement at an extremely high starting acceleration which almost approaches that of the motion of a projectile within a weapon barrel, in that there is produced a support of the object against the bubble and the reaction forces from the surrounding medium which act thereon Within the scope of the invention, it can, however, also be contemplated to arrange separately behind the propellant charge container a propulsion mechanism in the shape of a pressure-resistant cup, from the base of which there is produced a series of combustion gas shocks which, correspondingly, leads to a sequence of propelling combustion gas bubbles, in the surrounding medium which is incompressible with respect to this timely requirement. Correspondingly, a series of forward propelling impulses act on the anchoring object so as to drive this, for instance an open-bottomed tube, into the ground for a sample withdrawal.

Hereby, through a parabolic configuration of the internal bottom area of the propulsion mechanism, for the formation of the propellant gas bubbles, there can be made a provision that, subsequent to the completion of the gas flow from the propellant charge container, every gas bubble collapses along the walls of the propulsion mechanism, and thereby will act in a forward propelling direction against the bottom of the drive mechanism so as to thereby act on the object which is to be driven into the ground in accordance with a type of introducing force like a water hammer blow.

For the generation of the sequentially forming and thereafter collapsing combustion gas bubbles, the propellant charge can be apportioned into small units which, in the manner of a weapon self-loading device, can be stopped in timed sequence to be brought into the effective region of the detonating device; in essence, delivers combustion gas in sequence for a new double-impulse (as a result of the build up and collapse of a new gas bubble).

BRIEF DESCRIPTION OF THE DRAWINGS

Additional alternatives and modifications, as well as further features and advantages of the invention, may be ascertained from the following detailed description of the invention illustrative of preferred embodiments of arrangements for the acceleration of an object having reference to the accompanying drawings; in which.

DETAILED DESCRIPTION

Figure 1:
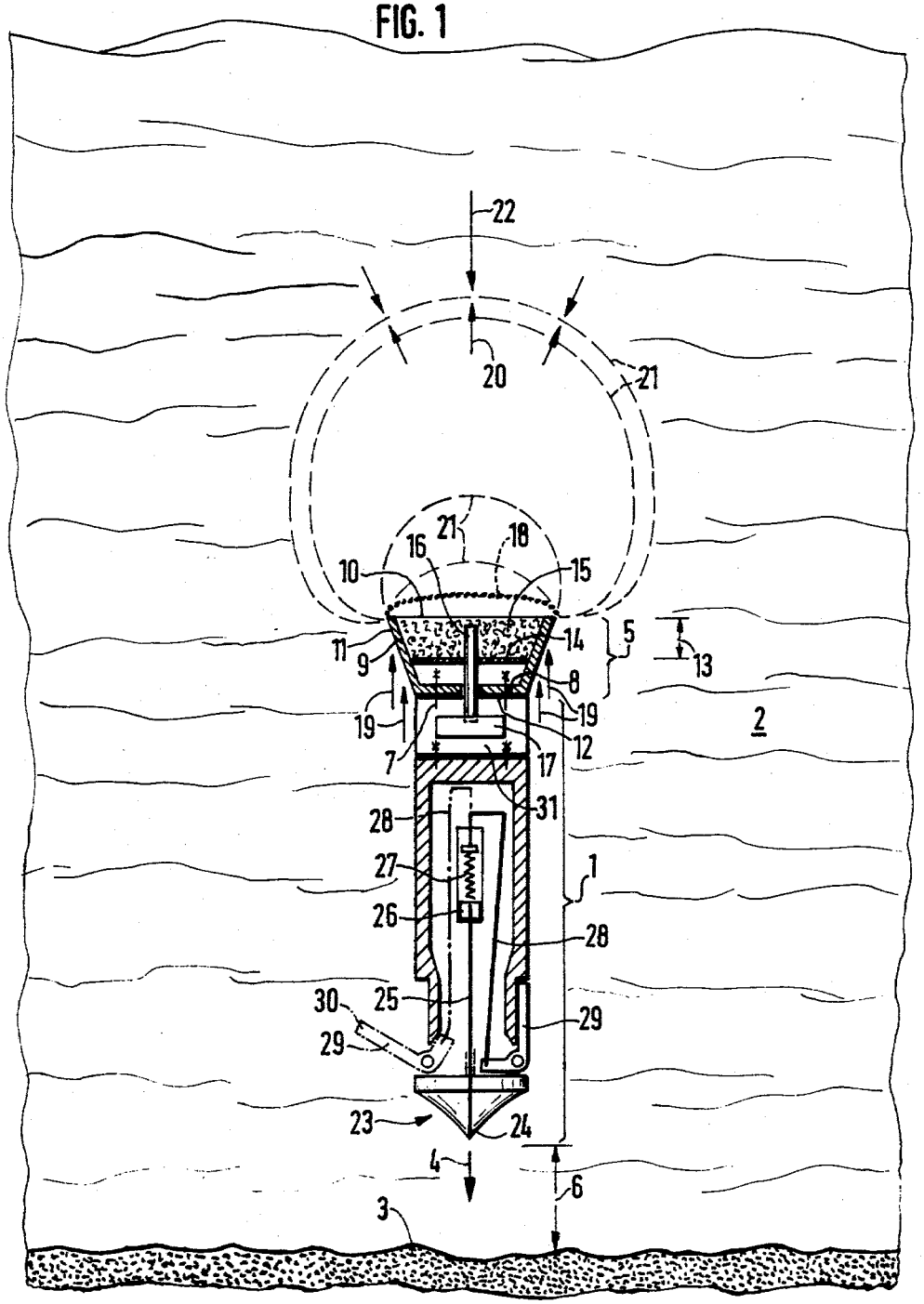
FIG. 1 illustrates, in a generally sectional view, the interaction of a propulsion arrangement with an anchoring object which is to be driven into the ground as a result of its impact velocity.

The piercing or penetrating object 1 which is illustrated in FIG. 1 of the drawing should be propelled forwardly through a surrounding medium 2 having a density which is higher than the density of gases, in this instance through water, in the direction towards its bottom or seabed 3, in essence, the ocean bottom.

For this purpose the object 1 is equipped with a propulsion arrangement 5 acting against the acceleration or forward driving direction 4, in effect towards the rear end thereof, with a forward driving arrangement 5. This arrangement should furnish the object 1 with an impulse-like force in the direction 4 over a period of time; in effect, with a force which quite rapidly rises to an extremely high value, and thereafter notwithstanding the forward motion of the object 1 in the direction 4 of introduction of the force will still be effective over a predetermined period of time interval before the effect of this force again significantly weakens and attenuates. Hereby, the object 1 should, in its forward drive in direction 4, have an extremely intensive acceleration imparted thereto, so that upon traversing an unhindered path of travel 6 to the seabottom 3, it will strike thereagainst with a high velocity and, for example, as more closely described hereinbelow, will burrow in and anchor itself.

For this purpose, the propulsion arrangement 5 which can be fastened, for example, in a load-transmissive or form-fitting manner, such as by means of a screw connection 7, to the rear surface 8 of the object 1 which is to be accelerated, incorporated a container 9 which in its' rearward facing or bottom area 10 openable to the surrounding medium 2 and thereby opposite to the forward driving direction. This container 9 is a rotationally-symmetrical hollow member which is constructed, for example, of a sheet metal casing 11 having a closure surface facing toward the object 1 and thereby in the forwarding driving direction 5, formed by a cover plate 12, or simply contact with the rear surface of the adjoining object to provide a tight seal therewith. The geometric configuration of the sheet metal casing 11 can be that of a hollow cylinder, or preferably as illustrated in the drawing, a hollow truncated cone which, at its connecting end, conforms to the diameter of the object 1.

The container 9 is filled to a predetermined but variable height 13 with a propellant charge 15 through an insert 14 which is supported opposite to the forward driving direction 4. An ignition tube 16 extends through the container 9 for the propellant charge to the bottom region 10 thereof, and consequently to the rearward area of the propellant charge 15, in order to ignite the propellant charge 15 from its rearward or bottom region 10 thereof so as to allow it to burn down in the forward driving direction 4. The ignition by means of the igniting tube 16, which, for example, can also be a fuse cord, is effected from a triggering device 17 which, for instance, can be time controlled or remotely-controlled (not detailed in the drawing).

The combination constituted of the propulsion arrangement 5 and the penetrating object 1 is preferably positioned at a distance (selected in conformance with the particular conditions) in a traveling path 6 opposite the bottom ground 3, within the surrounding medium 2. For this purpose there can be provided a rope suspension from a buoy (not shown in the drawing), or a buoyance member 18 provided on the object 1 or on the propulsion arrangement 5, as symbolically shown in the drawing, which not only ensures the desired orientation, for example, vertical orientation, in the medium 2 relative to the bottom 3 up to the time of ignition of the propellant charge 15, but can also be designed to maintain the object 1 floatingly within the surrounding medium 2 in a predetermined sinking or exposed height prior to the ignition of the propulsion arrangement 5, through the desired time interval.

The duration of the propulsion effect of the propellant charge 15 is variable through its filling height 13. The material for the propellant charge 15 is to be selected so that (with ripping open of the bottom area 10) it will rapidly burn down and thereby generate the largest possible quantity of combustion gases, and smoke gases which can be provided, if required through smoke gas-generating additives in the material of propellant charge 15. Efforts are made to attain the highest possible explosion-like type burn down speed, namely over 100 m/s and if possible up to 2000 m/s. Already with currently pyrotechnic materials such as, for example, those based on potassium perchlorate, or with rapidly and defined burn-down propellant powders such as those which, for example, are based on nitrocellulose or nitroglycerine as the propellant charge 15, the weight of the propellant charge 15 need only be about 2% of the weight of the object 1, at the dimension of a surface of the bottom area 10 which is approximately between one to two times the size of the surface of the rear side 8 of the object. A height 13 for propellant charge of a magnitude of up to the diameter of the bottom area 10 provides a longer continuing initial acceleration, which is almost of the magnitude of the acceleration of a projectile achieved during firing in a gun barrel, and thereby an impact against the ground or ocean bottom 3 at a correspondingly higher velocity and resultingly higher penetrating energy for the object 1.

This initial acceleration which is outstandingly high with respect to the surrounding medium 2, is obtained in that insofar as can be determined, the casing 11 of the propellant charge container 9, notwithstanding the explosion like rapid course of propellant charge combustion, will not spring away sideways but in all instances, in effect, with an originally cylindrical container 9, is spread apart in a somewhat conical shape opposite to the forward propulsive direction 4, until there is obtained a stabilizing counterpressure due to dynamic damming from oncoming flow 19 of the surrounding medium 2 (opposite to the explosive force interiorly of the container 9) on the basis of the forward motion in the direction 4 immediately after the commencement of the combustion sequence. Since even without the presence of a propulsion mechanism which is dimensioned in the form of a pressure or thrust cup (through this mechanically-stabilizing effect of the onflow 19 in the region of the outer wall of the container 9) the casing 11 thereof will retain its direction stabilizing effect for the propulsive force 20, which are generated during the combustion of the propellant charge 15 with components overwhelmingly acting opposite the forward propulsive direction 4, behind the bottom area 10 of the propulsion arrangement 5 there builds up a constantly spreading combustion gas bubble 21 within the surrounding medium 2. This bubble displaces the surrounding medium 2 (the timewise loading opposite the incompressible) so that, as long as there has not been developed any pressure wave equilibrium, there will be formed reaction forces 22 in the medium. Due the subsequent formation of combustion gases from the propellant charge 15 and because of the reaction forces 22, the bubble 21 exerts a strong pressure component against the bottom area 10 of the propellant charge container 9 and thereby on the propulsion arrangement 5 in the forward propelling arrangement direction 4. The object 1 is thus set into motion over a period of time, which is variable for a given material for the propellant charge 15 through its filling height 13, for example, until on the basis of the geometric and kinetic conditions the initially closed bubble 21 tears open, so as to move at a projectile-like starting velocity from the stationary position in a defined direction 4.

The constructive measures which stabilize the traveling direction can be provided on the anchoring object 1 (not illustrated in the drawing). A directional stabilization is however already produced in that the enormous starting acceleration leads to the formation of a closed cavitation mantle about the object 1, which is thereby physically isolated from the surrounding medium and will move in a spatially stable manner within this flow-dynamically favorable mantle environment.

At a full-cavitating geometry of this generally highly accelerated object 1, the striking direction is also maintained within the bottom or ground 3, in which a cavitating effect caused by the high-velocity impact leads to a desirable reduction in the penetrating friction due to an energy rich slinging away of the material particles of the bottom or ground 3, in effect to a good penetrating behavior for the object 1.

In order to achieve a secure anchoring in the ground 3, the object 1 can incorporate a head 23 which, due to its material selection and configuration, has a shape similar to that of a percussion drill tip 24. At an impact transmission device 25 can be provided in order to trigger, through a delay device 26, a setting device 27; for example, an energy accumulator or a stepping motor, which in turn, for example, will extend grapples 29 by means of a linkage 22, as is illustrated in the drawing for both the retracted position and for the extended position (shown in phantom lines). At the introduction of a force into the anchoring object 1 opposite to the penetrating direction 4, the released arms 30 thereof will burrow into the ground 3 in the outwardly swung direction, so that the object 1 will remain securely anchored. A coupling element 31 for the fastening of the propulsion arrangement 5, within which there can also be positioned the triggering device 17 for the propellant charge 15, can be equipped (not shown in the drawing) at the sides or in the direction towards the burned-out container 9, with fastening means for anchor lines or for mechanical structures, which should be fixed at the location of the striking of the anchoring object 1 against the ground 3.

Figure 2:
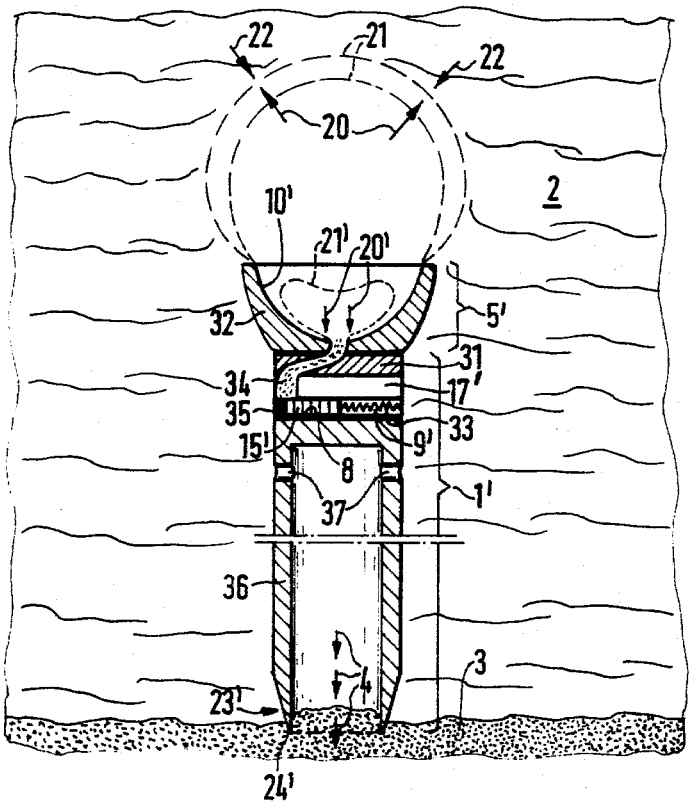
FIG. 2 is a view similar to that of FIG. 1, showing a modified embodiment of a propulsion arrangement for the driving in of a soil sample retrieving probe through the initiation of a sequence of impulses.

Referring to the modified embodiment as illustrated in FIG. 2 of the drawings, this in particular relates to a conduit or tube 36 providing the object 1' for the withdrawal of ground or soil samples below the water. Herein, there is constructively provided a separation between the propellant container 9' and the inherent propulsion arrangement 5' which is now formed as a pressure cup 32 with a propulsion mechanism function for the rearward ejection of the combustion gases; in effect, does not require dynamic damming from the surrounding medium 2 against loads with radial pressure components from the burning-down propellant charge 15. The propellant charge 15' herein consists of pyrotechnic, mutally isolated portions, which are displaced forwardly (shown in the drawing by a pressure spring symbol) by a sequential-loading device 33 in segments into the ignition actuating region of the triggering device 17'. Combustion residues can remain sealed therein, or pushed out through a smoke gas passageway 34 or through a pressure relief valve 35 during the course of the subsequent infeed of a new propellant charge portion which is to be ignited. The smoke gas passageway 34 terminates in the center of the bottom area 10' of the propulsion mechanism-pressure cup 32, which is internally shaped rotationally-symmetrical relative to the propulsion direction 4, and in cross-section evidences, for example, a parabolic configuration which is open opposite to the propulsion direction 4.

Due to the division of the propellant charge 15 into individual, timewise defined, sequentially ignitable small charge portions, there is currently produced a combustion gas bubble 21 which, due to the respectively small volume of combustion gas, will only expand for a short time with the generation of reaction forces 22, and because of the lack of a subsequent delivery of combustion gases, will again soon collapse into itself. This collapsing of the bubble 21' takes place along the curved inner wall of the propulsion mechanism bottom area 10' in a direction towards the bottom center, with the result of additional impulse-like force introduction corresponding to the effect of water percussion in the direction of the anchoring propulsion direction 4 prior to the ignition of the subsequent propellant charge portion. Thus, through the ignition of presently one propellant charge portion, there are generated two force introducing impulses, namely, once during the build up of the combustion gas bubble 2 and, shortly thereafter, through the water percussion-like collapsing of this bubble 21'. Produced thereby is a sequence of short percussion blows oriented in the propulsion direction 4 of the soil probe object 1', for the successive penetration into the ground 3 constituted of semi-hard or hard sediments, in the type of a short stroke ram effect; so that in every instance, upon each new formation of a new gas bubble 21, the piercing impulse evidences such a time behavior that, as a result of cavitation phenomena, the penetrating resistance is again extensively reduced.

The soil probe object 1', for the remainder, can be formed in the region of its head end 23' with an annular cutting tip 24'. In the area behind the tube 36 the propellant charge container 9' is equipped with the infeed arrangement 33 and triggering 17' such as, for example, a coupling element 31 for the connection of a lifting device for raising the punched out sediment core. In the end region of the tube 36, opposite the head 23', there are suitably formed apertures 37, in order to inhibit the build up of excess pressure in the tube 36 which would hinder the penetration into the ground 3.

What is claimed is:

1. In an arrangement for the generation and imparting of a propulsive force to an object for impelling said object through a surrounding liquid medium of a density which is higher than the density of gases, such as an object which is to be driven into a sea bottom; the improvement comprising: said object including a rotationally-symmetrical container at its trailing side facing opposite the direction of propulsion thereof, and extending coaxially with the object and the accelerating direction thereof; a rearwardly-opening propellant cup communicating with said container and having a diverging hollow truncated conical shape with the smaller end surface thereof fastened to the rearward side of said container and the wider open end facing said surrounding liquid medium; a combustible propellant charge in said container constituted of a plurality of propellant charge portions; and triggering means for sequentially igniting said propellant charge portions for developing high-energy combustion gases exiting opposite the direction of acceleration of said object, said gases being collected into collaborating bubbles in said propellant cup immediately rearwardly of said container acting in opposition to the dynamic damming effect of the denser surrounding liquid medium rearwardly of said propellant cup so as to accelerate said container including the object in front thereof in an axial direction.

2. Arrangement as claimed in claim 1, wherein said object has a geometry providing for a full-cavitating effect when propelled through a liquid medium by said propellant charge.

3. Arrangement as claimed in claim 1, wherein said object includes outwardly extendable grapples in the region of its head end; and delay means in operative communication with impact transmission means for actuating said grapples.

* * * * *